US009623277B2

(12) United States Patent
Thompson et al.

(10) Patent No.: US 9,623,277 B2
(45) Date of Patent: Apr. 18, 2017

(54) BODY SUPPORT STRUCTURE WITH FOCAL IMPLEMENTS FOR AIDING IN MENTAL FOCUS, BALANCE, AND BODY ALIGNMENT

(71) Applicants: Dennis Paul Thompson, Lakeway, TX (US); Charles Austin Murphy, Jr., Austin, TX (US)

(72) Inventors: Dennis Paul Thompson, Lakeway, TX (US); Charles Austin Murphy, Jr., Austin, TX (US)

( * ) Notice: Subject to any disclaimer, the term of this patent is extended or adjusted under 35 U.S.C. 154(b) by 148 days.

(21) Appl. No.: 14/333,415

(22) Filed: Jul. 16, 2014

(65) Prior Publication Data

US 2016/0016028 A1 Jan. 21, 2016

(51) Int. Cl.
*A63B 6/00* (2006.01)
*A63B 21/00* (2006.01)

(52) U.S. Cl.
CPC ..... *A63B 21/4037* (2015.10)

(58) Field of Classification Search
CPC ..... A63B 6/00
USPC ..... 5/417, 420, 907; 482/23, 142
See application file for complete search history.

(56) References Cited

U.S. PATENT DOCUMENTS

| | | | | |
|---|---|---|---|---|
| D457,373 | S | 5/2002 | Prinzmetal | |
| 7,108,635 | B2 | 9/2006 | Howlett-Campanella | |
| 8,096,923 | B2 | 1/2012 | White | |
| 8,317,660 | B2 | 11/2012 | Goranson | |
| D678,703 | S | 3/2013 | Ntoukas | |
| 2002/0142888 | A1* | 10/2002 | Marques | A63B 6/00 482/23 |
| 2003/0017915 | A1 | 1/2003 | Prinzmetal | |
| 2011/0072581 | A1* | 3/2011 | Villa | A63B 21/4037 5/420 |

* cited by examiner

*Primary Examiner* — Fredrick Conley
(74) *Attorney, Agent, or Firm* — David O. Simmons

(57) ABSTRACT

A Yoga mat with a main body having an upper surface and a plurality of Drishti points at the upper surface of the Yoga mat body. The Drishti points are symmetrically spaced along a perimeter edge of the upper surface. The Drishti points are within a perimeter border region of the upper surface. The Drishti point can be carried by a discrete body that is selectively engagable with and disengagable from the Yoga mat body for allowing Drishti points of different design configuration. The upper surface of the Yoga mat body can be configured with one or more inferred lines, which can be aligned with one or more of the Drishti points. The upper surface can also include one or more centrally located symmetric alignment features, which can be aligned with one or more of the Drishti points and/or one or more of the inferred lines.

14 Claims, 2 Drawing Sheets

BODY SUPPORT STRUCTURE WITH FOCAL IMPLEMENTS FOR AIDING IN MENTAL FOCUS, BALANCE, AND BODY ALIGNMENT

FIELD OF THE DISCLOSURE

The disclosures made herein relate generally to exercise equipment and, more particularly, to a body supporting structure with focal implements for aiding in mental focus and body alignment.

BACKGROUND

During an exercise practice such as Yoga, a key objective is for a person engaged in the exercise practice to align and balance their bodies, and search for one or more focused reference points. In Yoga, these focused reference points are generally referred to as Drishti points and a person engaged in the Yoga practice is commonly referred to as a Yogi. Often times, as an available Drishti point, a Yogi will utilize an imperfection on a used Yoga (i.e., exercise) mat upon which the Yogi is performing their Yoga, a mark on a floor, or a mark on a wall. In contrast to alignment marks that are provided on an exercise mat for indicating a specific point where an exerciser is to place a part of their body (e.g., their foot or hand), a Drishti point is a visual reference point that provides for spatial alignment, balance, and mental focus. In this regard, the underlying purpose of visually locating and focusing on a Drishti point is to assist with body alignment and focus for better balance, concentration and meditation.

Approximately 50% of Yoga postures place the body in a position where the Yogi is looking at their Yoga mat. Locating a Drishti point quickly aids the Yogi in properly placeing the body in a given posture quickly, thereby beneficially enabling them to remain in the given posture and focus much longer. From a focus point of view, focus time is lengthened as well, therefore, deepening concentration, balance and meditation, all of which are essential aspects of getting the maximum benefit of a Yoga practice. Furthermore, because Yoga practices generally include a series of multiple postures in succession, reducing time in locating a Dristhi (focus) point between properly aligned postures is significantly reduced, therefore lengthening/increasing focus time, which enhances the practice physically and deepens the practice mentally.

As can be seen, the way in which Yoga and other types of similar exercises are currently practiced, there are random visual references that are difficult to locate, that are not specifically configured for deep focus, and whose location can be time consuming and unpredictable to locate and focus on. As a result, a practitioner of such exercises is not able to get the full benefit of their exercise practice. Therefore, a body supporting structure (e.g., an exercise mat or Yoga mat) with focal implements specifically configured for aiding in achieving improved alignment, concentration, balance, and meditation would be beneficial, desirable and useful.

SUMMARY OF THE DISCLOSURE

Embodiments of the present invention are directed to a body supporting structure (i.e., an exercise surface) such as, for example, a mat, carpet or towel, with integrated graphics and/or structure to aid with mental focus and body alignment in the practice of exercises such as Yoga, Pilates, and the like. Exercises such as Yoga use focal points, sometimes called Drishti (i.e., referred to herein as Drishti points), and structures providing inferred reference lines to help the practitioner (i.e., a Yogi in the case of Yoga) achieve balance and to remove distractions and enhance meditation. Advantageously, these one or more types of visual focal implements are provided in a manner in which they provide reliable and predictable visual references, thereby significantly reducing the amount of time it takes a Yogi to locate and visually engage a suitable focus point. Accordingly, in preferred embodiments, the body supporting structure is configured as a Yoga mat with focal implements specifically configured for aiding a Yogi to achieve improved alignment, concentration, balance, and meditation during their Yoga practice.

In one embodiment of the present invention, exercise equipment comprises a body supporting structure and a plurality of spaced-apart non-embedded visual reference points. The body supporting structure has an upper surface, a lower surface, and at least one side surface extending between the upper and lower surfaces. The spaced-apart non-embedded visual reference points are provided at an upper surface of the body supporting structure. All of the non-embedded visual reference points are within a perimeter border region of the upper surface.

In another embodiment of the present invention, a Yoga mat comprises a Yoga mat body having an upper surface and a plurality of standalone Drishti points at the upper surface of the Yoga mat body. All of the standalone Drishti points are symmetrically spaced along a perimeter edge of the upper surface. All of the standalone Drishti points are within a perimeter border region of the upper surface.

These and other objects, embodiments, advantages and/or distinctions of the present invention will become readily apparent upon further review of the following specification, associated drawings and appended claims.

DETAILED DESCRIPTION

Figure 1:
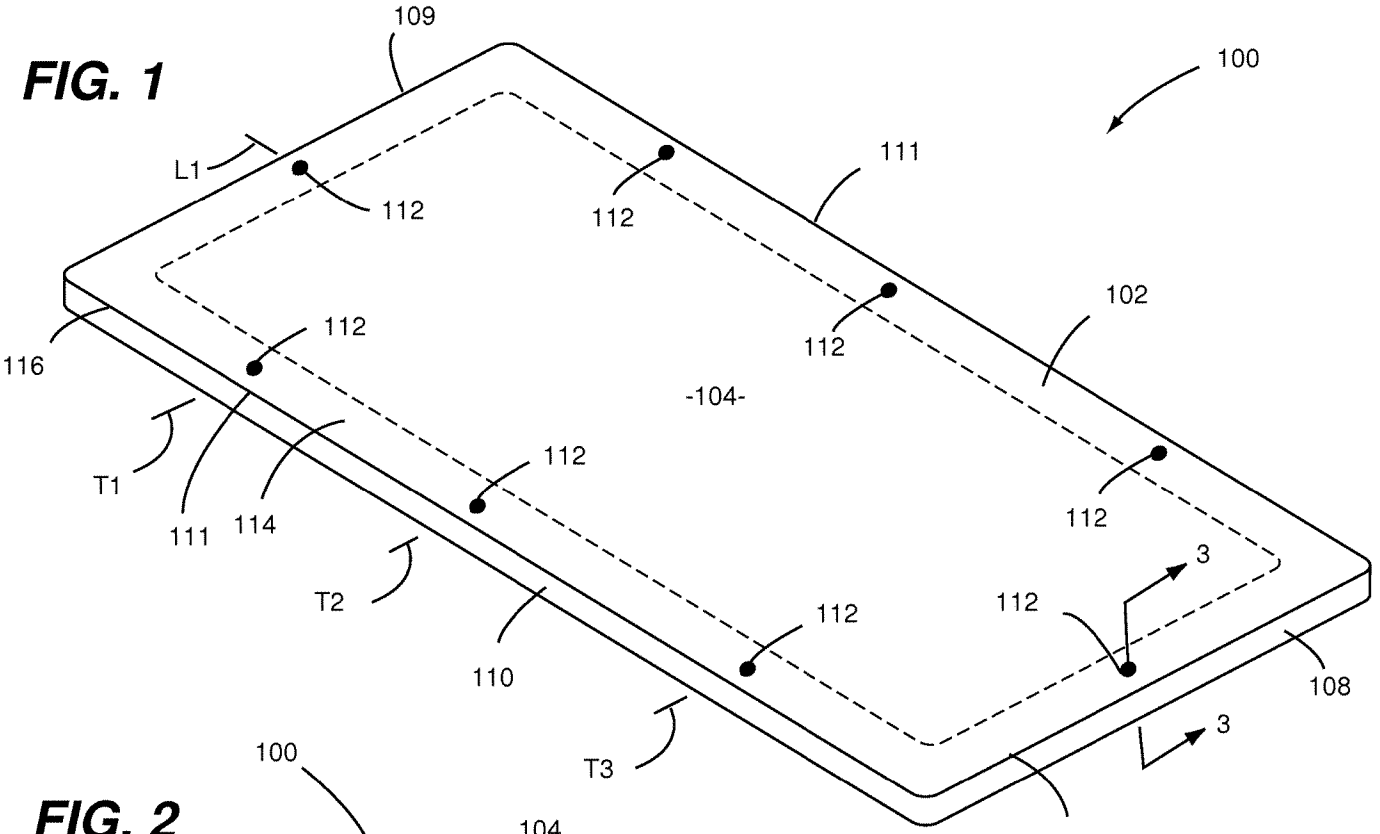
FIG. 1 is a perspective view showing a Yoga mat configured in accordance with an embodiment of the present invention.
Figure 2:
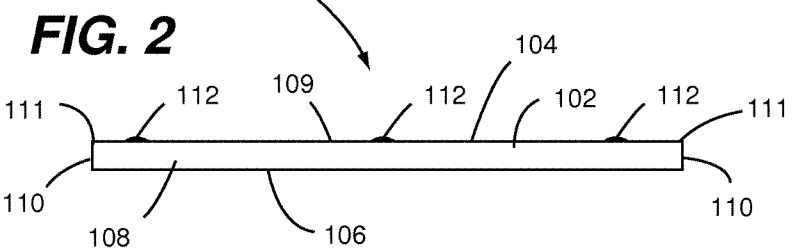
FIG. 2 is an end view of the Yoga mat shown in FIG. 1.
Figure 3:
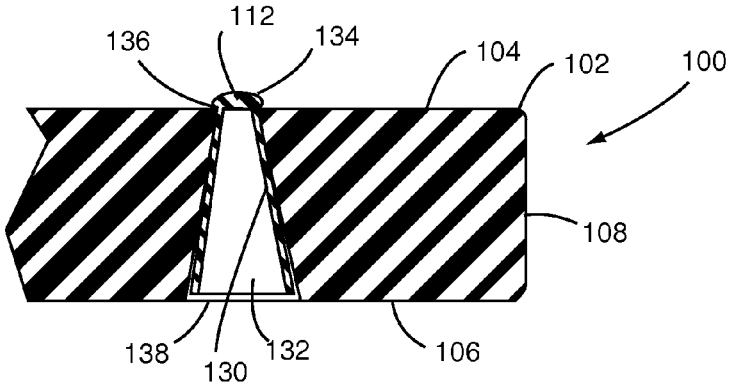
FIG. 3 is a cross-sectional view taken along the line 3-3 in FIG. 1.

FIGS. 1-3 show a Yoga mat 100 configured in accordance with an embodiment of the present invention. It is disclosed herein that the Yoga mat 100 is a specific example of a body supporting structure configured in accordance with the present invention. An exercise mat, a towel, and carpet are other examples of a body supporting structure configured in accordance with the present invention. In this respect, embodiments of the present invention are not limited to use in any particular activity or to any type of body supporting structure.

The Yoga mat 100 includes a main body 102 (i.e., a Yoga mat body). The main body 102 has an upper surface 104, a lower surface 106, opposing end surfaces 108 and opposing sides surfaces 110. The opposing end surfaces 108 and opposing sides surfaces 110 each extend between the upper surface 104 and the lower surface 106. Opposing ends 109 of the main body 102 are defined by the opposing end surfaces 108 and opposing sides 111 of the main body 102 are defined by the opposing sides surfaces 110.

As shown in FIG. 1, the main body 102 is rectangular in shape. However, a main body configured in accordance with the present invention is not limited to being any particular shape. For example, a main body configured in accordance with the present invention can be a shape that has only one side surface (e.g., round or elliptical shaped), can be a shape with fewer than four side surfaces (e.g., triangular shaped), or can have more than four side surfaces (e.g., pentagon shaped).

The main body 102 can be made from any number of commercially-available materials. A foam material made from Poly-Vinyl Chloride (PVC) is one example of a suitable material for the main body 102. Examples of other suitable materials include, but are not limited to, foam made from natural rubber, foam made from synthetic rubber, foam made from a thermoplastic elastomer, and the like. It is disclosed herein that a main body configured in accordance with the present invention is not limited to being made from a particular material.

As best shown in FIG. 1, the Yoga mat 100 includes a plurality of spaced-apart standalone Drishti points 112 at the upper surface 104 of the main body 102. As shown in FIG. 1, the standalone Drishti points 112 are discrete points that are not an integrated element of (e.g., not embedded within) a multi-element visual reference point. In this respect, each one of the standalone Drishti points 112 is an example of a non-embedded visual reference point. A symmetrically shaped alignment mark, such as that disclosed below in greater detail, is an example of a multi-element visual reference point.

All of the Drishti points 112 are within a perimeter border region 114 of the upper surface 104. The inner border of the perimeter border region 114 is denoted by the dotted line in FIG. 1. The Drishti points 112 at the opposing ends 109 of the main body 102 (i.e., a first one and a second one of the Drishti points 112) lie on a longitudinal reference axis L1 extending along a length of and bisecting the upper surface 104. The Drishti points along the opposing sides 111 of the main body 102 are each aligned with a respective on of a plurality of transverse axes T1, T2, T3. Each one of the transverse axes T1, T2, T3 extend perpendicularly across the longitudinal axis L1.

Preferably, but not necessarily, all of the Drishti points 112 are located at a common distance from a perimeter edge 116 of the upper surface 104. The perimeter edge defines the outer border of the perimeter border region 114. As shown in FIG. 1, preferably, but not necessarily, all of the Drishti points 112 are symmetrically spaced around the perimeter edge 116 of the upper surface 104. Preferably, but not necessarily, all of the Drishti points 112 have an identical design configuration.

Examples of design configuration parameters include, but are not limited to shape, size, color and texture. Accordingly, in view of the disclosures made herein, a skilled person will appreciate that a first portion of the Drishti points 112 (e.g., those adjacent to the ends 109 of the main body 102) can be of a first design configuration (e.g., a first size and/or a first color) and a second portion of the Drishti points 112 (e.g., those adjacent to the sides 111 of the main body 102) can be of a second design configuration (e.g., a second size and/or a second color). Although embodiments of the present invention are not limited to Drishti points of a particular size, an example of a range of diameters (e.g., round Drishti points) and/or edge lengths of Drishti points (e.g., polygon shaped Drishti points) is from about 1 mm to about 10 mm.

It is disclosed herein that the Drishti points 112 can be colored dots (circular shaped or otherwise). The color can be solid, a half-tone pattern, or other type of pattern. Furthermore, in the context of the present invention, different hues, saturations and densities of a particular color are disclosed herein as being different colors. In this respect, the upper surface 104 can be of a particular color (i.e., the base color) and one or more of the Drishti points 112 can be, for example, a half-tone variant of that base color. It is disclosed herein that the main body 102 and one or more of the Drishti points 112 can be contrasting base colors (e.g., red and blue), which can be implemented for causing the visual effect with respect to the Drishti point (e.g., the Drishti point appearing to be moving toward or away from the Yogi).

Referring now to FIG. 3, it can be seen that the Drishti point 112 can be integral with a Drishti point body 130 (i.e., a visual reference point body). The Drishti point body 130 has a tapered extension portion 132 and a head portion 134. An undercut 136 is defined between the tapered extension portion 132 and a head portion 134. The main body 102 includes a tapered passage 138 that extended between the upper surface 104 and lower surface 106. The Drishti point body 130 is engaged within the tapered passage 138 from the lower surface 106 such that the tapered extension portion 132 of the Drishti point body 130 is engaged with the tapered passage 138 of the main body 102. The undercut 136 engages a top edge of the tapered passage 138 for securing the Drishti point body 130 within the tapered passage 138. Alternatively, a portion of the tapered extension portion 132 (e.g., its bottom edge) can be configured to engage a mating portion of the main body 102 for securing the Drishti point body 130 within the tapered passage 138.

When the tapered extension portion 132 of the Drishti point body 130 is engaged with the tapered passage 138 of the main body 102, the head portion 134 of the Drishti point body 130 is exposed at the upper surface 104, thereby providing visual access to the Drishti point 112. Although the head portion 134 is shown as being raised above the upper surface 104 of the main body 102, it is disclosed herein that the head portion can be flat and substantially flush with the upper surface 104 of the main body 102. In this respect, the Drishti point body 130 is selectively detachable from and attachable to the main body 102. Furthermore, this ability of the Drishti point body 130 to be selectively detachable from and attachable to the main body 102 (i.e., the perimeter border region thereof) allows for the Drishti point body 130 to be removed and replaced with a different Drishti point body having a differently configured head portion that provides a Drishti point with a different design configuration (e.g., a different color, different size, different texture, and/or different shape).

The Drishti point body 130 and associated tapered passage 138 of the main body is one example of a means of providing the Drishti points 112 at the upper surface 104 of the main body 102. However, embodiments of the present invention are not limited to any particular means of providing one or more Drishti points at the upper surface of a main body 102. Other examples of such means include, but are not limited to, one or more Drishti points 112 being applied directly to the main body 102 as indicia (e.g., printed or painted on), one of more Drishti points 112 being applied to the main body 102 as an appliqué (e.g., adhesive or static stickers), one of more Drishti points 112 being applied to the main body 102 through use of magnetic attraction (e.g., first magnetic component embedded/attached to main body and second magnetic component carrying/being Drishti point), one of more Drishti points 112 being applied to the main body 102 through use of mechanical fastener (e.g., pin that sticks into main body), and the like.

Figure 4:
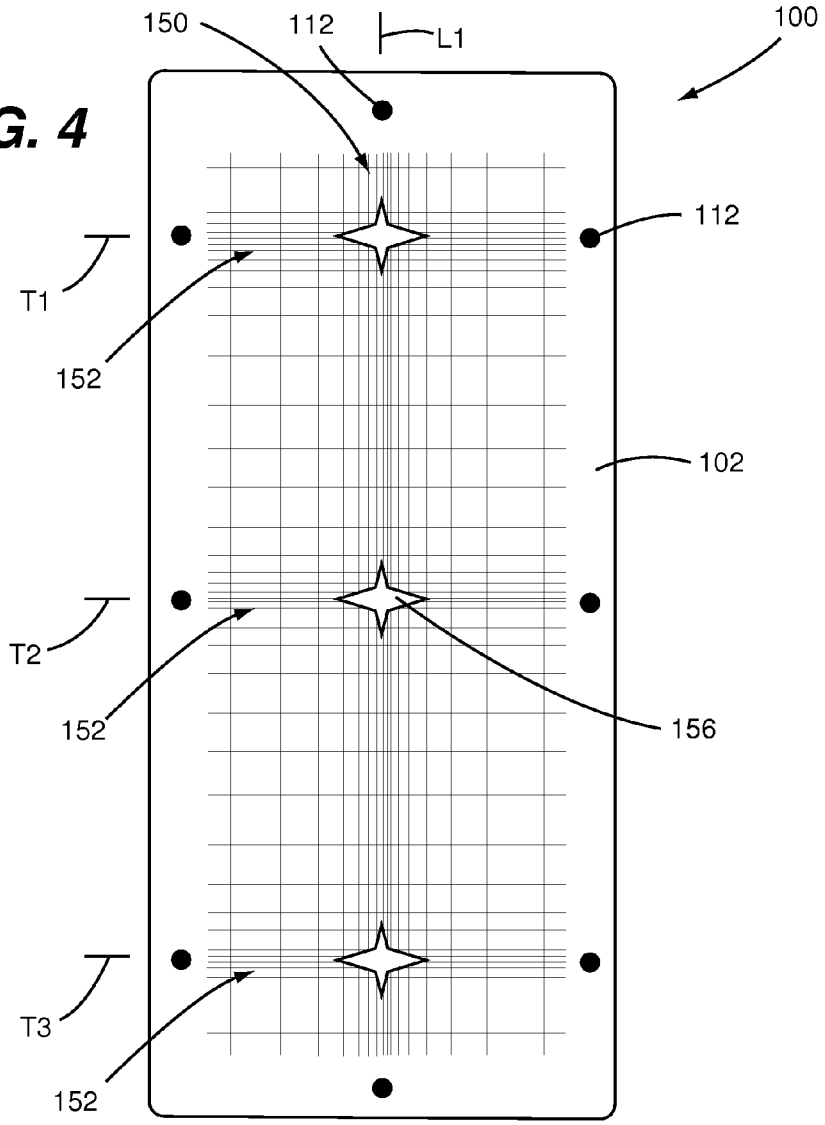
FIG. 4 is a plan view showing the Yoga mat of FIG. 1 with the addition of inferred lines and symmetrically shaped alignment marks.

FIG. 4 shows an embodiment of the present invention in which the Yoga mat 100 includes indicia that provides inferred lines. In the depicted embodiment, indicia in the form of spaced apart lines that provide a pattern defining a vertical inferred line 150 and a plurality of horizontal inferred lines 152. In other embodiments, the pattern defining the vertical inferred line 150 and the horizontal inferred lines 152 can be in the form of, for example, half tone shading, an image, an artistic design, or the like. The vertical inferred line 150 is substantially aligned with the longitudinal reference axis L1 and, thus, the Drishti points 112 that are aligned therewith. The horizontal inferred lines 152 extend perpendicularly across the longitudinal reference axis L1 and are each aligned with a respective one of the transverse axes T1, T2, T3 and, thus, the Drishti points that are aligned therewith.

As shown, the spaced apart lines that provide the pattern defining the vertical inferred line 150 and the horizontal inferred lines 152 is within an area encompassed by the inner border of the perimeter border region 114 (See dotted line in FIG. 1). It is disclosed herein that the inferred lines can extend fully to the sides 110 of the main body 102 or to a location within the perimeter border region 114. Furthermore, it is disclosed herein that the pattern defining the vertical inferred line 150 and the horizontal inferred lines 152 can be present only in the perimeter border region 114. Still further, as shown in FIG. 4, it is disclosed herein that a symmetrically shaped alignment mark 156 (e.g., in the form of indicia, an appliqué, or the like) can be provided at the intersection of the longitudinal reference axis L1 and one or more of the transverse axes T1, T2, T3. It is also disclosed herein that a symmetrically shaped alignment mark configured in accordance with an embodiment of the present invention can include one or more embedded visual reference points (i.e., one or more embedded Drishti points) and/or visual reference points that are directly associated therewith (e.g., located immediately adjacent thereto).

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A body support structure, comprising:

a main body having an upper surface, a lower surface, and at least one side surface extending between the upper and lower surfaces;

body alignment information at the upper surface of the main body; and a plurality of spaced-apart non-embedded visual reference points at the upper surface of the main body within a perimeter border region of the upper surface, wherein an inner border of the perimeter border region has a shape the same as a shape of the upper surface of the main body, wherein the inner border of the perimeter border region is centered within a perimeter edge of the upper surface, wherein a maximum width dimension and a maximum length dimension of each one of the non-embedded visual reference points is less than about 10 mm, wherein a first one and a second one of the non-embedded visual reference points lie on a longitudinal reference axis extending along a length of and bisecting the upper surface, wherein the first and second one of the non-embedded visual reference points are located at opposing ends of the main body, wherein a third one and a fourth one of the non-embedded visual reference points lie on a transverse axis extending perpendicularly across the longitudinal reference axis, wherein the third and fourth one of the non-embedded visual reference points are located at opposing sides of the main body and wherein the inner border of the perimeter border region encompasses the body alignment information such that all of the non-embedded visual reference points are within the perimeter border region of the upper surface and all of the body alignment information is within an area encompassed by the inner border of the perimeter border region.

2. The body support structure of claim 1 wherein all of the non-embedded visual reference points are indicia printed on the upper surface.

3. The body support structure of claim 1 wherein:

all of the non-embedded visual reference points are located at a common distance from the perimeter edge of the upper surface;

a width of the perimeter border region is uniform;

all of the non-embedded visual reference points are substantially round;

a maximum diameter of each one of the non-embedded visual reference points is less than about 10 mm; and the width of the perimeter border region is approximately twice a minimum distance from a center of each one of the non-embedded visual reference points to the perimeter edge of the upper surface.

4. The body support structure of claim 1 wherein:

the body alignment information includes a plurality of discrete alignment elements in a pattern that visually creates an inferred line;

all of the non-embedded visual reference points are symmetrically spaced around the perimeter edge of the upper surface; and the inferred line extends between and is substantially aligned with two opposing ones of the non-embedded visual reference points.

5. The body support structure of claim 1 wherein:

all of the non-embedded visual reference points are located at a common distance from the perimeter edge of the upper surface;

all of the non-embedded visual reference points have an identical design configuration;

the body alignment information includes a plurality of spaced-apart alignment marks at the upper surface of the main body; and each one of the alignment marks is located between and is substantially aligned with a respective pair of the non-embedded visual reference points.

6. The body support structure of claim 1 wherein:

the body alignment information includes a plurality of spaced-apart alignment marks at the upper surface of the main body; and each one of the alignment marks is respectively aligned with two opposing ones of the non-embedded visual reference points.

7. The body support structure of claim 1 wherein:

at least one of the non-embedded visual reference points is integral with a non-embedded visual reference point body that is selectively detachable from and attachable to the main body; and the at least one of the non-embedded visual reference points has a maximum width less than about 10 mm.

8. The body support structure of claim 7 wherein the non-embedded visual reference point body and the perimeter border region are jointly configured for enabling the non-embedded visual reference point body to be selectively detachable from and attachable to the main body.

9. The body support structure of claim 8 wherein the non-embedded visual reference point body includes a retention feature that is selectively engagable with and disengagable from a mating retention feature of the main body.

10. A Yoga mat, comprising:

a Yoga mat body having an upper surface;

a plurality of standalone Drishti points at the upper surface of the Yoga mat body within a perimeter border region of the upper surface, wherein an inner border of the perimeter border region has a shape the same as a shape of the upper surface of the Yoga mat body, wherein the inner border of the perimeter border region is centered within a perimeter edge of the upper surface, wherein all of the standalone Drishti points are symmetrically spaced along a perimeter edge of the upper surface, wherein all of the standalone Drishti points are within a perimeter border region of the upper surface, wherein all of the standalone Drishti points are substantially round, wherein a diameter of each one of the non-embedded visual reference points is less than about 10 mm, wherein all of the non-embedded visual reference points are located at a common distance from a perimeter edge of the upper surface, wherein a width of the perimeter border region is approximately twice the common distance; and a plurality of spaced-apart alignment marks at the upper surface of the Yoga mat body, wherein each one of the alignment marks is located on a longitudinal reference axis of the upper surface and is respectively aligned with two opposing ones of the standalone Drishti points, wherein the inner border of the perimeter border region encompasses the spaced-apart alignment marks such that all of the non-embedded visual reference points are within the perimeter border region of the upper surface and all of the spaced-apart alignment marks are within an area encompassed by the inner border of the perimeter border region.

11. The Yoga mat of claim 10, further comprising:

a first plurality of discrete alignment elements at the upper surface in a pattern that visually defines a first inferred line;

wherein the first inferred line extends between and is substantially aligned with a first one and a second one of the standalone Drishti points;

wherein a shape of the upper surface is rectangular;

wherein the first one and the second one of the standalone Drishti points lie on the longitudinal reference axis extending along a length of and bisecting the upper surface;

wherein each one of the alignment marks lies on the longitudinal reference axis;

wherein the first inferred line extends along the longitudinal reference axis; and wherein the first one and the second one of the standalone Drishti points are located at opposing ends of the Yoga mat body.

12. The Yoga mat of claim 11, further comprising:

a second plurality of discrete alignment elements at the upper surface in a pattern that visually defines a second inferred line extending perpendicularly across the longitudinal reference axis;

wherein the second inferred line extends between and is substantially aligned with a third one and a fourth one of the standalone Drishti points.

13. The Yoga mat of claim 10 wherein:

at least one of the standalone Drishti points is integral with a Drishti point body that is selectively detachable from and attachable to the Yoga mat body;

the Drishti point body and the perimeter border region are jointly configured for enabling the Drishti point body to be selectively detachable from and attachable to the Yoga mat body.

14. The Yoga mat of claim 13 wherein a shape of the upper surface is rectangular.

* * * * *